United States Patent [19]

Yan

[11] Patent Number: 4,508,614

[45] Date of Patent: Apr. 2, 1985

[54] VISBREAKER PERFORMANCE FOR PRODUCTION OF HEATING OIL

[75] Inventor: Tsoung Y. Yan, Philadelphia, Pa.

[73] Assignee: Mobil Oil Corporation, New York, N.Y.

[21] Appl. No.: 614,711

[22] Filed: May 29, 1984

Related U.S. Application Data

[63] Continuation of Ser. No. 439,662, Nov. 8, 1982, abandoned.

[51] Int. Cl.[3] ..... C10G 9/14; C10G 53/16

[52] U.S. Cl. ..... 208/78; 208/106

[58] Field of Search ..... 208/78, 106, 126

[56] References Cited

U.S. PATENT DOCUMENTS 2,160,814 6/1939 Arveson ..... 208/78
2,358,573 9/1944 Hemminger ..... 208/126
2,695,264 11/1954 Taff et al. ..... 208/106
2,733,192 1/1956 Sage ..... 208/106
3,065,165 11/1962 Amis et al. ..... 208/106

OTHER PUBLICATIONS

Nelson, Petroleum Refinery Engineering McGraw Hill, 1958, p. 650.

*Primary Examiner*—Delbert E. Gantz
*Assistant Examiner*—Glenn A. Caldarola
*Attorney, Agent, or Firm*—Alexander J. McKillop; Michael G. Gilman; Malcolm D. Keen

[57] ABSTRACT

The present invention provides a process for the conversion of heavy hydrocarbon oil to stable heating oil products which involves improving visbreaker performance via optimum operational severity for individual heavy hydrocarbon oil feedstocks and subsequently blending the respective visbroken effluents to provide one or more heating fuels or gas oil streams.

5 Claims, 2 Drawing Figures

Fig. 1

SHAKER BOMB DATA
TOLUENE-INSOLUBLES FORMATION TENDENCY OF VISBREAKER CHARGE STOCKS

| NO. | STOCK | ASPHALTENE CONTENT, % WT. |
|---|---|---|
| 1. | 12% Oficino-Ouico residuum | 24.44 |
| 2. | P.D. Tar from Kuwait 346 stock | 14.00 |
| 3. | 24 % Kuwait residuum | 10.90 |
| 4. | Petrolatum | 6.60 |
| 5. | Furfural extract from Tibu Petrolea 362 stock | 3.32 |
| 6. | Petrolatum filtrate | 3.12 |
| 7. | TCC No. 2 Syn. tower bottoms | 2.92 |
| 8. | TCC No. 1+2 Syn. tower bottoms blend | 2.66 |
| 9. | TCC No. 1 Tar separator bottoms | 2.59 |
| 10. | TCC No. 1 Syn. tower bottoms | 2.53 |
| 11. | TCC No. 2 Tar separator bottoms | 1.78 |
| 12. | Furfural extract from coastal grade A 678 stock | 1.20 |
| 13. | P.D. Raffinate from Kuwait 346 stock | 0.98 |
| 14. | Furfural extract from Kuwait 346 stock | 0.38 |

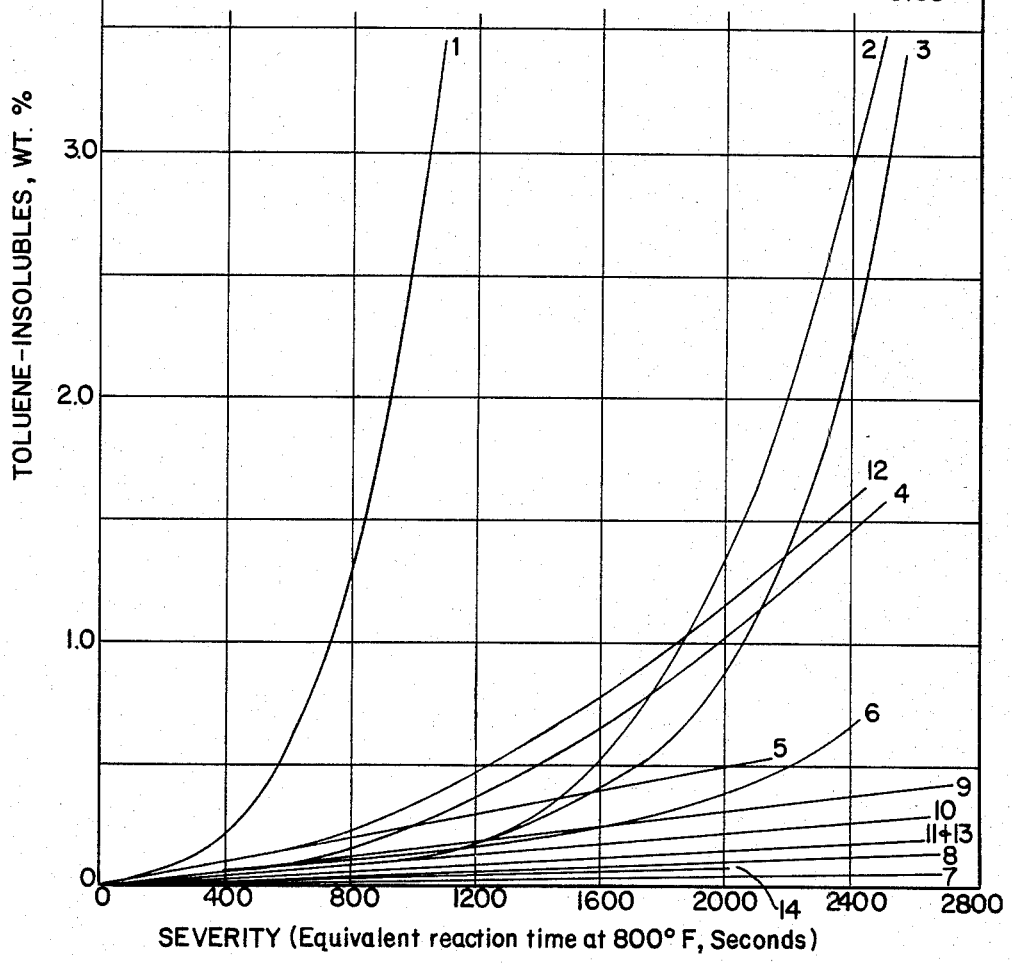

VISBREAKER PERFORMANCE FOR PRODUCTION OF HEATING OIL

This is a continuation of copending application Ser. No. 439,662, filed on Nov. 8, 1982, now abandoned.

BACKGROUND OF THE INVENTION

Visbreaking is a mild cracking operation used to reduce the viscosity of heavy residua. The heavy residua are sometimes blended with valuable lighter oil, or cutter stocks, to produce fuel oils of acceptable viscosity. By use of visbreakers, the viscosity of the heavy residua is reduced so as to reduce the requirement of the cutter stock. The ultimate objective of the visbreaking operation is to completely eliminate the need for cutter stocks.

Sometimes visbreakers are also used to generate more gas oils for catalytic cracking and naphtha for reforming to increase the gasoline yield in the overall refining operation. To achieve these goals, the visbreaker has to be operated at high enough severity to generate sufficient quantities of lighter products.

The visbreaker feedstock usually consists of a mixture of two or more refinery streams derived from sources such as atmospheric residuum, vacuum residuum, furfural-extract, propane-deasphalted tar and catalytic cracker bottoms.

Most of these feedstock components, except the heavy aromatic oils, behave independently in the visbreaking operation. Consequently, the severity of operation for a mixed feed is limited greatly by the least stable (highest insolubles formation) components. As a result, the potential for light product generation of the more desirable components can not be realized.

Accordingly, it is an object of this invention to provide a process for improving the performance of visbreakers for the production of an increased yield of light products such as heating oil and gas oil.

It is another object of this invention to provide a process for the production of a visbroken hydrocarbon product which meets heating oil viscosity specifications with little or no blending with external cutter stocks.

It is a further object of this invention to provide an improved visbreaking process for the production of two or more visbroken effluents which are stable and compatible and which can be blended together and/or with other fuel range stocks without formation of sludge or precipitate.

Other objects and advantages of the present invention will become apparent from the accompanying description and Example.

DESCRIPTION OF THE INVENTION

One or more objects of the invention are accomplished by the provision of a process for increasing the conversion of heavy hydrocarbon oil to stable heating oil by improving visbreaker performance in steps which comprise (1) selecting at least two heavy oil feedstocks from the group consisting of atmospheric residuum, vacuum residuum, furfural-extract, propane-deasphalted tar and catalytic cracker bottoms; (2) visbreaking each heavy oil feedstock individually at the highest Severity that yields not more than about 0.5 weight percent toluene-insolubles formation as determined by Shaker Bomb test; and (3) recovering the individual visbroken effluents and blending them to provide a heating oil product.

An important aspect of the invention process is the improvement of visbreaker performance by optimizing operation severity for individual heavy oil feedstocks.

The severity of visbreaking zone conditions is expressed in terms of Severity(S), which is equal to Soaking Factor multiplied by reaction time. The parameters are reaction temperature and reaction time.

Severity is conveniently expressed in terms of "equivalent reaction time in seconds" (ERT), as measured at 800° F.

The expressions "Severity"(S) and "Soaking Factor"(SF) as employed herein refers to the following algorithmic relationship of visbreaking parameters:

Severity(S)=Soaking Factor($SF_{800}$)×Residence Time($\theta$)

Since the coil temperature is not uniform, the average soaking factor(SF) for the whole coil reactor is obtained as follows:

$$SF_{100} = \int_0^V \int_{800}^{T_f} \left(\frac{k_T}{k_{800}}\right) dT dV$$

In order to express Severity(S) in terms of ERT as measured at 800° F., the SF relative to that at 800° F. has to be employed.

To integrate the above equation, the coil temperature profile relating to the reactor volume V (indirectly through distance L) has to be determined experimentally or calculated, which can be expressed mathematically as follows:

$$T=f(L)=F(V)$$

By differentiation, we obtain:

$$dT = F'(V)dV \; dV = \frac{1}{F'(V)} dT$$

Therefore, $SF_{800}$ becomes:

$$SF_{800} = \int_{800}^{T_f} \left(\frac{k_T}{k_{800}}\right) \frac{dT}{F'(V)}$$

and the equation can be integrated either analytically or graphically to obtain $SF_{800}$.

Where:

T, $T_f$=coil temperatures at any position and the outlet, respectively, °F.

$SF_{800}$=soaking factor relative to that at 800° F. base temp.

($k_T/k_{800}$)=ratio of reaction rate constants at T and 800° F.

dV=differential coil volume, $ft^3$/bbl/day.

$\theta$=residence time, seconds.

L=distance from the inlet, ft.

Note that $S=SF_{800}\times\theta$ (the first equation above). That is, Severity is proportional to residence time($\theta$); that is why the severity is often expressed in terms of $\theta$, i.e., equivalent reaction time at 800° F.

As the severity level in a visbreaking zone increases, the toluene-insolubles formation tendency increases. This results in production of unstable visbroken effluent.

The toluene-insolubles forming tendency varies greatly depending on the nature of an individual heavy oil feedstock, i.e., the particular chemical constituency of the feedstock, the quantity and kind of impurity content, and the like.

In the production of heavy fuel oil, the stability of the product depends on the Severity at which each of the blended feedstocks is visbroken. If all of the feedstock components in the fuel oil blend are visbroken at a Severity which produces less than about 0.5 weight percent toluene-insolubles (Shaker Bomb test), then the resultant fuel oil blend is stable. A heavy fuel oil is said to be stable if it does not form sedimentation on storage (as indicated by ASTM D2781 method). Under the mild visbreaking conditions described herein, the coke deposition on heater surfaces is negligible during plant scale operation.

The toluene-insolubles forming tendency of various heavy oil feedstocks can be determined by "Shaker Bomb" tests. Typical results are illustrated in FIGS. 1 and 2.

BRIEF DESCRIPTION OF THE FIGURES

FIG. 1 represents a graph in which weight percent toluene-insolubles formation is plotted versus Severity (equivalent reaction time in seconds at 800° F.), with respect to Shaker Bomb toluene-insolubles formation tendency of visbreaker chargestocks.

Figure 2:
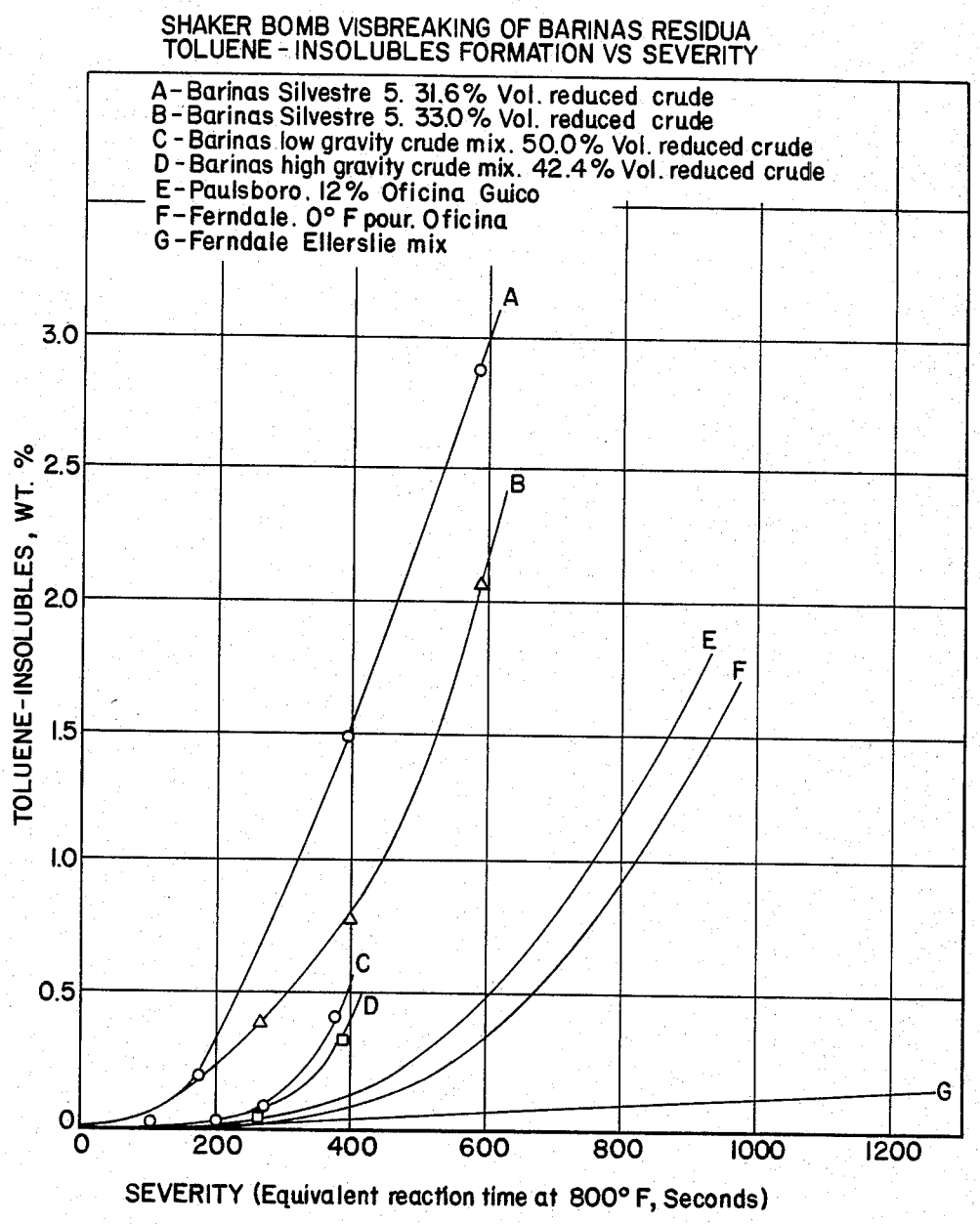
FIG. 2 represents a graph in which weight percent toluene-insolubles formation is plotted versus Severity (equivalent reaction time in seconds at 800° F.), with respect to Shaker Bomb visbreaking of Barinas residua.

For purposes of the present invention process, the severity conditions in any visbreaking zone is limited to the highest level at which there is not more than about 0.5 weight percent toluene-insolubles formation during a visbreaking cycle, so as to ensure the production of stable visbroken effluent.

In general, each visbreaking operation will comprise the steps of (1) heating a heavy hydrocarbon oil feedstock at a temperature between about 800°-1000° F. (425°-550° C.) and a pressure between about 400-2000 psi for a soak period between about 0.1-2 hours sufficient to convert at least about 60 weight percent of the heavy hydrocarbon oil to gas oil and heating oil range hydrocarbons, substantially without the formation of a deleterious quantity of toluene-insolubles; and (2) recovering the visbroken effluent for blending with one or more other individually recovered visbroken effluents.

The term "heavy hydrocarbon oil" is meant to include petroleum oil residua and tar sand bitumen feedstocks, in which mixtures of at least 75 weight percent of the constituents have a boiling point above about 700° F. (370° C.).

Employing a conventional visbreaker system, the present invention heavy oil feedstocks can be passed individually and consecutively through the same visbreaking zone. The difference in severity levels for the individual feedstocks is achieved most advantageously by a difference in residence times as determined by Severity calculations.

In another type of visbreaker system, the individual heavy oil feedstocks are passed separately and concurrently through different visbreaking zones, each of which is operated with optimal severity conditions (temperature and residence time) for the respective heavy oil feedstocks.

When the optimal highest Severity for the two visbreaker zones differ relatively by more than about 100 seconds, i.e., the equivalent reaction time in seconds (ERT) at 800° F., it is advantageous to employ the present invention process. The visbreaking is particularly advantageous when the highest Severity for at least one heavy oil feedstock is less than about 800 seconds, and for at least one other feedstock is greater than about 900 seconds, as expressed in equivalent reaction time at 800° F. Whether there are two or three or more feedstocks, each is visbroken at its optimum severity as contemplated by the present invention.

The boiling range of a heavy oil feedstock has a direct effect on the visbreaking severity required to achieve the desired visbreaking result. For example, the optimal Severity for efficient conversion of a high viscosity residuum type oil and a medium viscosity heavy hydrocarbon oil averages about 800 and 2000 seconds, respectively. A typical high viscosity oil will have a viscosity of more than about $1\times10^6$ cs at 100° F., and a medium viscosity oil will have a viscosity of about 100,000-500,000 cs at 100° F.

The visbroken effluents from either the single visbreaker system or the multi-visbreaker system are recovered and blended to yield one or more heating oil products and, optionally, gas oil fractions.

A particularly significant advantage of the invention process is the fact that the respective visbroken effluents are stable and compatible with each other, and can be blended together and/or with other fuel stocks without the formation of sludge or precipitate.

The following Example is further illustrative of the present invention. The specific ingredients and processing parameters are presented as being typical, and various modifications can be derived in view of the foregoing disclosure within the scope of the invention.

Illustrative of a suitable Shaker Bomb system for purposes of the Example procedures, the reactor (bomb) is 4" in diameter and about 12" in length. The reactor is heated by high frequency electrical induction while the contents are being vigorously agitated by a reciprocal shaking action. This arrangement permits the reactor and its contents to be heated at extremely high rates (up to 40° F./sec.). The reactor may be cooled at any time with a jet of cold air, or it can be quenched at the end of the heating cycle by a spray of water. The quench-cooling rate is in the order of 20° F./sec.

Upon completion of the Shaker Bomb visbreaking reaction, the product is emptied into a breaker, and the reactor is washed with hot toluene (100° C.). The wash solution and the product are combined and further diluted with toluene to five times the original volume. This diluted solution is heated to 100° C. and then filtered through Whatman #2 filter paper. The filter cake is washed with toluene and then dried in a 100° C. oven until the weight is constant. The weight of the cake corresponds to the toluene-insolubles in the product.

EXAMPLE

This Example illustrates improved visbreaker performance for production of stable heating oil with economy of cutter stock requirement in accordance with the present invention process.

I.

By means of a Shaker Bomb test system as described above, it is established that the highest Severity at which Arab Heavy Resid and Iranian Light Resid can be visbroken without high toluene-insoluble formation and fuel instability are 600 seconds and 1000 seconds, respectively, with reference to equivalent reaction time (ERT) at 800° F.

lowers the cutter stock requirement, which is a main object of the present invention.

TABLE

| | Visbreaking Severity And The Requirement For Cutter Stock | | | | | | | | | |
|---|---|---|---|---|---|---|---|---|---|---|
| Run No. | 1 | 2 | 3 | 4 | 5 | 6 | 8 | 9 | 10 | 11 |
| Resid | Arab Heavy 970° F.+ | | Iranian Light 900° F.+ | | | | | Arab Heavy & Iranian Light (50/50) | | |
| Severity, Sec. at 800° F. | Feed | 600 | Feed | 600 | 750 | 1000 | Feed | 600[1] | 600A/750I[2] | 600A/1000I[3] |
| 270° F.+Bottom Viscosity 100° F., cs | $7.5 \times 10^6$ | 9200 | 45,650 | 4495 | 2210 | 1115 | 451,217 | 6384 | 4374 | 2988 |
| Cutter Stock[4] required, % of resid to be blended[5] | 52.4 | 18.5 | 28.5 | 13.5 | 9.2 | 2.3 | 40.5 | 16.0 | 13.3 | 10.4 |

[1]Two feeds precombined and visbroken at 600 sec.
[2]Separate visbreaking, Arab Heavy and Iranian Light at 600 and 750 sec., respectively.
[3]Separate visbreaking, Arab Heavy and Iranian Light at 600 and 1000 sec., respectively.
[4]Straight run gas oil with viscosity of 3 centistokes at 100° F.
[5]To be blended to 3500 sec. Redwood #1 at 100° F.

II.

As summarized in the Table, the Heavy Arab Resid is visbroken in Run 2 at a Severity level of 600 seconds (maximum allowable Severity), while the Iranian Light Resid is visbroken at 600, 750 and 1000 seconds, respectively (Runs 4–6).

In addition, a mixture of Arab Heavy Resid and Iranian Light Resid (50/50) is visbroken (Run 9) at a Severity level of 600 seconds, which is the maximum Severity allowable as limited by the most reactive component, i.e., the Arab Heavy Resid.

The visbroken products are stabilized by distillation to obtain the 270° F.+ bottom products. The viscosities are measured at 100° F. Finally, these products are blended with straight run light gas oil (3 cs viscosity at 100° F.) to the specifications of 3500 seconds Redwood #1 at 100° F. The required cutter stock quantities are listed in the Table. As the visbreaking Severity increases, the cutter stock requirement decreases.

III.

The 270° F.+ bottom product from visbreaking Iranian Light at 750 and 1000 seconds are blended with that from the Arab Heavy at 600 seconds. The products are blended with straight run gas oil (3 cs at 100° F.) to the specifications of 3500 seconds Redwood #1 at 100° F. (Runs 10–11).

The cutter stock requirement for Runs 10–11 are significantly lower, i.e., 17% and 35% saving of cutter stock.

The data demonstrate that visbreaking the feed components separately to each respective highest optimal Severity and then blending the visbreaker effluents

What is claimed is:

1. A process for increasing the conversion of heavy oil to stable heating oil by improving visbreaker performance in steps which comprise (1) selecting at least two heavy oil feedstocks from the group consisting of atmospheric residuum, vacuum residuum, furfural-extract, propane-deasphalted tar and catalytic cracker bottoms, wherein at least 75 weight percent of the constituents of each feedstock have a boiling point above about 700° F.; (2) visbreaking each heavy oil feedstock individually at the highest Severity that yields not more than about 0.5 weight percent toluene-insolubles formation as determined by Shaker Bomb test, wherein the highest Severity for at least two of the heavy oil feedstocks differ relatively by more than about 100 seconds, as expressed in equivalent reaction time at 800° F.; and (3) recovering the individual visbroken effluents and blending them to provide a product comprising heating oil.

2. A process in accordance with claim 1 wherein the individual heavy oil feedstocks are passed consecutively through the same visbreaking zone.

3. A process in accordance with claim 2 wherein the difference in severity levels for the individual feedstocks is achieved by a difference in residence times.

4. A process in accordance with claim 1 wherein the individual heavy oil feedstocks are passed separately and concurrently through different visbreaking zones.

5. A process in accordance with claim 1 wherein the highest Severity for at least one heavy oil feedstock is less than about 800 seconds, and for at least one other heavy oil feedstock is greater than about 900 seconds, as expressed in equivalent reaction time at 800° F.

* * * * *

UNITED STATES PATENT AND TRADEMARK OFFICE

CERTIFICATE OF CORRECTION

PATENT NO. : 4,508,614

DATED : April 2, 1985

INVENTOR(S) : Tsoung Y. Yan

It is certified that error appears in the above-identified patent and that said Letters Patent is hereby corrected as shown below:

Col. 2, line 36:

$$dT = F(V)dV \quad dV = \frac{1}{F(V)} \quad dT$$

should be

-- $$dT = F' \quad (V) \; dV \qquad dV = \frac{1}{F'(V)} \quad dT$$ --

Col. 2, line 45:

$$SF_{800} = {}_{800}^{T_f} \left(\frac{k_T}{k_{800}}\right) \frac{dT}{F(V)}$$

should be

-- $$SF_{800} = \int_{800}^{T_f} \left(\frac{k_T}{k_{800}}\right) \frac{dT}{F'(V)}$$ --

Signed and Sealed this

*Fourth* Day of *February 1986*

[SEAL]

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,508,614

DATED : April 2, 1985

INVENTOR(S) : Tsoung Y. Yan

It is certified that error appears in the above-identified patent and that said Letters Patent is hereby corrected as shown below:

Column 1, line 53:

Insert --This patent application is a continuation-in-part of patent application Serial No. 281,158, filed July 8, 1981, now abandoned.--

Signed and Sealed this

*Third* Day of *June 1986*

[SEAL]

*Attest:*

DONALD J. QUIGG

*Attesting Officer*

*Commissioner of Patents and Trademarks*